United States Patent [19]

Sumikama et al.

[11] Patent Number: 4,824,061

[45] Date of Patent: Apr. 25, 1989

[54] MOUNTING ASSEMBLY FOR COOKING APPLIANCES

[75] Inventors: Yoshimitsu Sumikama, Nara; Yoshihiro Aramaki, Yamatokoriyama, both of Japan

[73] Assignee: Sharp Kabushiki Kaisha, Osaka, Japan

[21] Appl. No.: 147,437

[22] Filed: Jan. 25, 1988

Related U.S. Application Data

[63] Continuation of Ser. No. 82,691, Jul. 20, 1987, abandoned, which is a continuation of Ser. No. 775,828, Sep. 13, 1985, abandoned.

[30] Foreign Application Priority Data

Oct. 24, 1984 [JP] Japan ..... 59-161669[U]

[51] Int. Cl.[4] ..... F24H 9/06

[52] U.S. Cl. ..... 248/225.2; 248/309.1

[58] Field of Search ..... 248/225.2, 224.4, 220.2, 248/309.1, 313, 310, 311.2, 187; 312/242, 245; 292/226, 304, DIG. 14

[56] References Cited

U.S. PATENT DOCUMENTS

| | | | |
|---|---|---|---|
| 1,805,042 | 5/1931 | Heine | 292/DIG. 14 X |
| 2,146,700 | 2/1939 | Peterson | 292/DIG. 14 X |
| 2,851,588 | 9/1958 | Bodian et al. | 292/226 X |
| 4,313,043 | 1/1982 | White et al. | 312/242 X |
| 4,453,690 | 6/1984 | Takeuji | 248/309.1 |
| 4,465,256 | 8/1984 | Wolbrink et al. | 312/245 X |
| 4,720,622 | 1/1988 | Iwata et al. | 248/309.1 X |

*Primary Examiner*—Ramon S. Britts
*Assistant Examiner*—Karen J. Chotkowski
*Attorney, Agent, or Firm*—Flehr, Hohbach, Test, Albritton & Herbert

[57] ABSTRACT

A mounting assembly for a cooking appliance such as a combination microwave oven and range hood comprises a mounting plate to be secured on the wall and a back plate of the housing. These plates are adapted to be engaged together at the bottom. At the top, latching means and hooking means are provided so that the plates can be secured together merely by pressing them together until the latching and hooking means become engaged with respect to each other.

4 Claims, 3 Drawing Sheets

MOUNTING ASSEMBLY FOR COOKING APPLIANCES

This is a continuation of application Ser. No. 775,828 filed Sept. 13, 1985 abandoned which is a continuation of application Ser. No. 082,691 filed July 20, 1987, abandoned.

This invention relates to a mounting assembly for cooking appliances adapted to be mounted on a wall and to a combined microwave oven and range hood system with an improved mounting assembly for mounting it on a wall.

The conventional microwave oven and range hood combination, such as disclosed in U.S. Pat. No. 4,453,690 assigned to the present assignee, must be installed on a wall by operating a lever. Ordinary users are generally not accustomed to the operation of such a lever, and it has been considered desirable to devise an improved mounting means for installing a cooking appliance such as a combined microwave oven and range hood on a wall.

It is therefore an object of the present invention to provide a new mounting assembly for cooking appliances.

It is another object of the present invention to provide a combination microwave oven and hood assembly adapted to be mounted on a wall by means of an improved mounting assembly.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The above objects are achieved by providing a combination microwave oven and range hood provided with a mounting plate to be secured to a wall and a back plate to be secured engagingly to this mounting plate. Latching and hooking means are provided at top parts of these plates so that these plates, when they are secured with respect to each other, are engaged together at their bottom parts and the latching and hooking means are in mutually engaged relationship.

The present invention will be better understood from the detailed description given hereinbelow and the accompanying drawings which are given by way of illustration only, and thus are not limitative of the present invention and wherein:

FIG. 1 is an exploded perspective view of a portion of a combination microwave oven and range hood of this invention;

FIGS. 2 through 4 ((*a*) and (*b*)) are views of the portion of FIG. 1 seen in the directions of arrows a (*a*) and b (*b*), respectively, for explaining the mounting operation;

Figure 5:
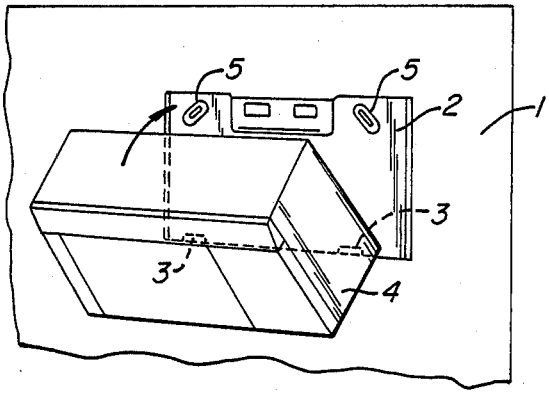
FIG. 5. PRIOR ART
FIG. 5 is a perspective view of a mounting operation of a conventional combination microwave oven and range hood.

There is shown in FIG. 5 how a combination microwave oven and range hood disclosed in U.S. Pat. No. 4,453,690 is mounted on a wall 1. A mounting plate 2 is secured first on the wall 1 by screw means and, while bottom engaging pieces 3 of the mounting plate 2 are hooked onto engaging indents at bottom parts of the back plate of the housing 4, the housing 4 is rotated as shown by an arrow in the figure so that the top parts of the back plate become engaged with bridge-like engaging projections 5 provided at the upper parts of the mounting plate 2 as shown more in detail in FIGS. 6 and 7.

Figure 6:
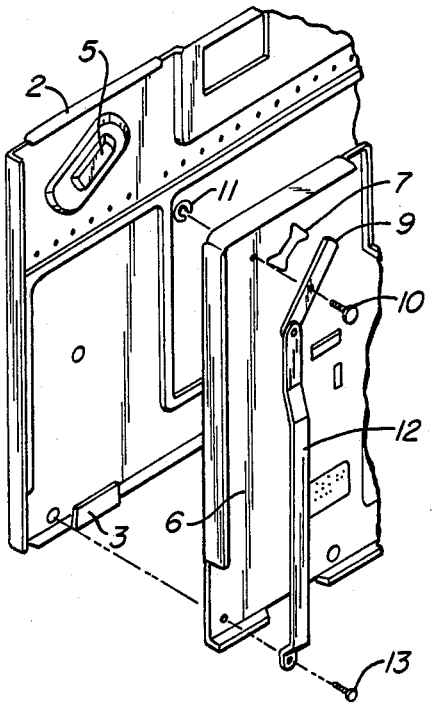
FIG. 6. PRIOR ART
FIG. 6 is an exploded perspective view of a conventional mounting assembly.
Figure 7:
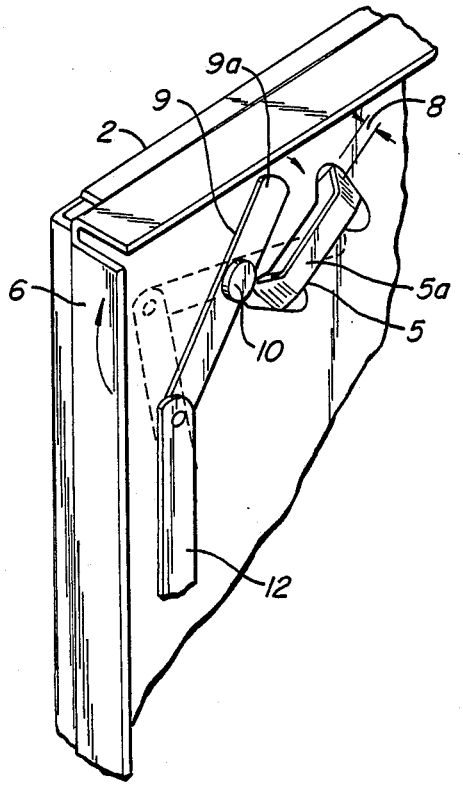
FIG. 7. PRIOR ART
FIG. 7 is an enlarged exploded perspective view of a portion of a conventional mounting assembly.

As shown in FIG. 6 which is an exploded perspective view of the aforementioned mechanism and FIG. 7 which is an enlarged drawing for explaining the engaging mechanism at the upper parts of the back plate of the housing, there are apertures 7 provided on the back plate 6 of the housing so that the bridge-like engaging projections 5 on the mounting plate 2 can pass therethrough. Near each aperture 7, there is a lock lever 9 rotatably mounted by means of a lever pin 10 and an E-ring 11 such that, when the bridge-like projection 5 fully penetrates the aperture 7 as shown in FIG. 7, the free end 9*a* (on the right-hand side in FIG. 7) can be inserted into or removed from the gap 8 created between the top part 5*a* of the bridge-like projection 5 and the peripheral surface of the back plate 6 around the aperture 7 to engage and disengage the back plate 6 from the mounting plate 2. At the other end (opposite the free end 9*a*), the lock lever 9 is rotatably connected to one end of an operating lever 12. The operating lever 12 is so structured that the other end thereof (the lower end) can be moved upward at the bottom of the housing 4 so as to place the lock lever 9 in the locked (engaged) position as shown by broken lines in FIG. 7 or downward so as to place the lock lever 9 in the released (disengaged) position as shown by solid lines. There is also provided a screw 13 by means of which the bottom end of the operating lever 12 can be secured so that the lock lever 9 remains in the locked (engaged) position. As mentioned above, however, users generally find it difficult to maneuver the operating lever 12 when the housing 4 is mounted on a wall.

Figure 1:
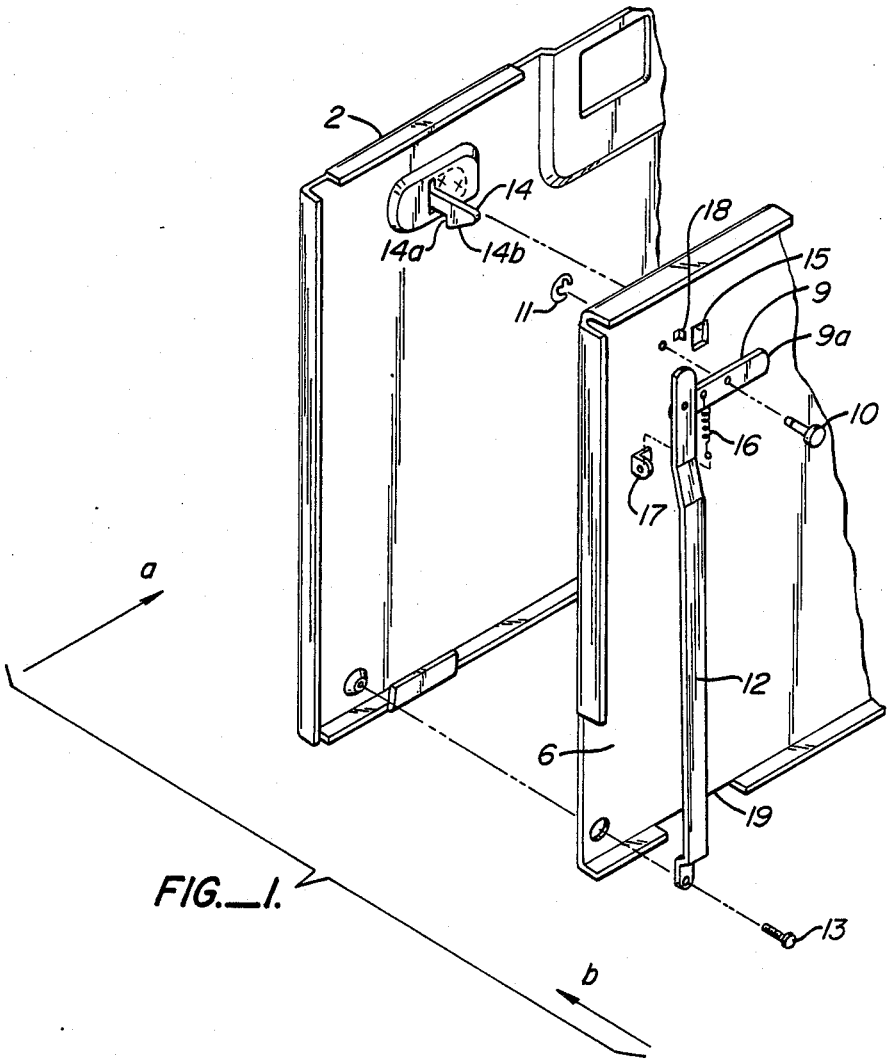

FIG. 1 is an exploded perspective view of a portion of a combination microwave oven and range hood of this invention. Components which are identical or similar to those in conventional systems illustrated in FIGS. 5–7 are assigned the same numerals and explanations therefor are omitted. In FIG. 1, numeral 14 indicates a latch head which is an L-shaped iron piece having a hooking section 14*a* near its end and is spot-welded to an attachment part formed protrudingly forward from the mounting plate 2. Correspondingly thereto, there is provided in the back plate 6 an aperture 15 for the latch head 14 to pass through. In addition, there is a spring 16 installed between a point on the lock lever 9 away from the lever pin 10 towards the operating lever 12 and a spring-hooking piece 17 secured to and protruding from the back plate 6 so that a biasing force is applied on the lock lever 9 in a counter-clockwise direction (as seen in FIG. 1) and the lock lever 9 functions as a latch hook. Numeral 18 indicates a protrusion for controlling the position of the lock lever 9 by stopping its rotation caused by the biasing force from the spring 16. The operational relationship between the latch head 14 and the lock head 9 functioning as a hook is explained below.

Figure 2A:
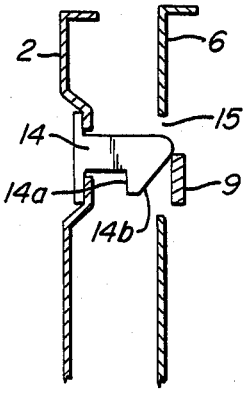
Figure 2B:
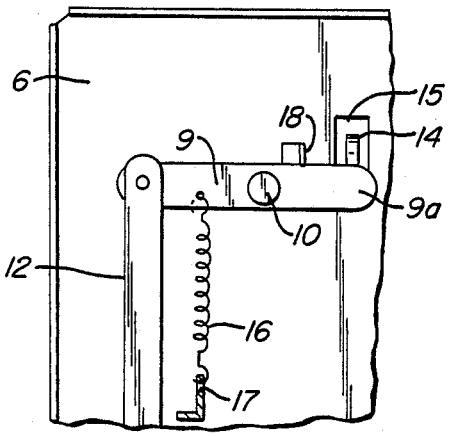
Figure 3A:
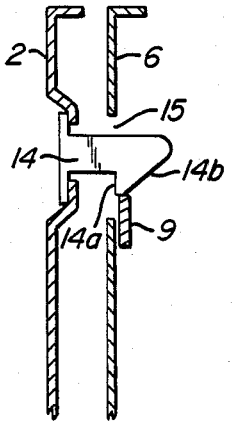
Figure 3B:
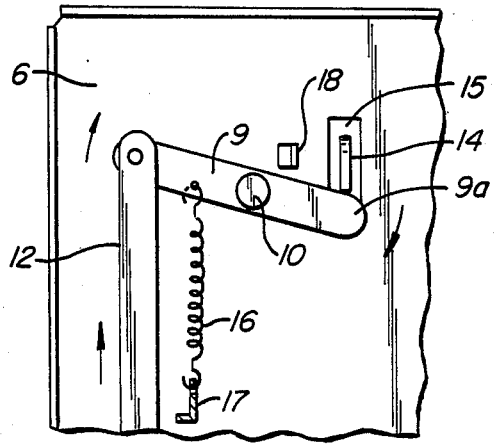
Figure 4A:
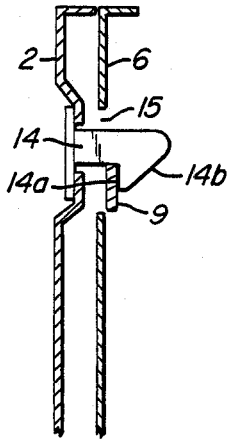
Figure 4B:
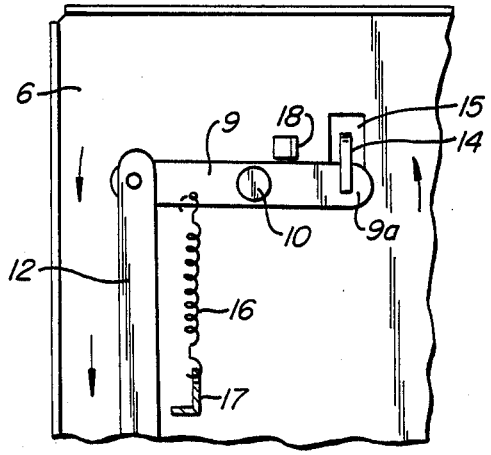

When the engaging means at the bottom of the back plate 6 (shown in FIG. 1 as an indentation in the bottom rim) is hooked to the engaging piece 3 at the bottom of the mounting plate 2 and the top part of the housing 4 is pressed against the mounting plate 2, the latch head 14 comes in contact with the right-hand end 9*a* of the lock lever 9 as shown in FIG. 2. As they are further pressed towards each other, the end 9*a* of the lock lever 9 slides along the sloped section 14*b* of the latch head 14 and this causes the lock lever 9 to rotate clockwise as shown in FIG. 3 against the biasing force of the spring 16. When the end 9*a* of the lock lever 9 passes the sloped section 14*b*, the lock lever 9 rotates counter-clockwise, engaging the end 9*a* of the lock lever 9 to engage with the hooking section 14*a* of the latch head 14 as shown in FIG. 4. The biasing force of the spring 16 maintains this engaged relationship thereafter. In order to prevent the latch head 14 from becoming disengaged from the locked lever 9 due to vibrations, etc. after the installed system comes to be used, a screw 13 is provided as shown in FIG. 1. to secure the bottom end of the operating lever 12 to the mounting plate 2.

When it is desired to dismantle the system from the mounting plate 2, the screw 13 is removed first and the bottom end of the operating lever 12 is moved upwards, causing the lock lever 9 to rotate clockwise and disengaging the latch head 14 from the lock lever 9.

In summary, the present invention relates to a cooking appliance such as a combination microwave oven and range hood adapted to be mounted on a wall by engaging a back plate of its housing with a mounting plate which is secured to the wall. The bottom ends of these plates are engaged first. Latching means are provided at the top section of either of these plates and hooking means at the top section of the other. These means are adapted to engage together so as to secure the system on the wall. This installation method is easy to the user and enhances the practical value of the cooking appliance.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the shape of the latch-hook is not limited to that illustrated above. The embodiment was chosen and described in order to best explain the principles of the invention and its practical application to thereby enable others skilled in the art to best utilize the invention in various embodiments and with various modifications as are suited to the particular use contemplated.

What is claimed is:

1. A mounting assembly for mounting a cooking apparatus with a back plate on a vertical wall, said assembly comprising a mounting plate adapted to be secured vertically to said wall, bottom sections of said back and mounting plates being engageable with respect to each others, and at least one set of securing means for securing said plates together, said one set of securing means including a latch head affixed at an upper part of either one of said plates and protruding horizontally therefrom, said latch head having a step-like hooking section and a sloping surface in front of said hooking section, an elongated operating lever disposed vertically, means for affixing said elongated operating lever to said bottom sections of said back and mounting plates after said plates are secured together, a lock lever rotatably supported around an axis at an upper part of the other of said plates and rotatably connected to said operating lever, and a biasing means for applying a biasing force on said lock lever around said axis, said securing means being so structured that said sloping surface presses said lock lever against said biasing force to rotate said lock lever around said axis and to engage said lock lever with said hooking section as said plates are caused to approach each other.

2. The assembly of claim 1 wherein said latch head is L-shaped and protrudingly secured to said mounting plate and said lock lever is rotatably secured to said back plate.

3. The assembly of claim 1 wherein said biasing means includes a spring with one end fastened to said lock lever and the other fastened to said back plate.

4. The assembly of claim 1 wherein said lock lever is substantially horizontal and is adapted to move downward by being pressed by said sloping surface of said latch head.

* * * * *